US008069901B2

(12) United States Patent
Nishikawa

(10) Patent No.: US 8,069,901 B2
(45) Date of Patent: Dec. 6, 2011

(54) CYLINDER BLOCK MANUFACTURING METHOD, DUMMY CYLINDER LINER, AND DUMMY CYLINDER LINER CASTING METHOD

(75) Inventor: Yoshinori Nishikawa, Matsuzaka (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 129 days.

(21) Appl. No.: 12/711,673

(22) Filed: Feb. 24, 2010

(65) Prior Publication Data

US 2010/0243191 A1 Sep. 30, 2010

(30) Foreign Application Priority Data

Mar. 31, 2009 (JP) ..... 2009-088079

(51) Int. Cl.
*B22D 17/12* (2006.01)
*B22D 19/08* (2006.01)

(52) U.S. Cl. ..... 164/98; 164/103; 164/113

(58) Field of Classification Search ..... 164/113, 164/119, 120, 306–312, 98–112
See application file for complete search history.

(56) References Cited

U.S. PATENT DOCUMENTS 7,568,515 B2 8/2009 Yoshihara et al.

FOREIGN PATENT DOCUMENTS

| | | | |
|---|---|---|---|
| JP | 60-46854 | A | 3/1985 |
| JP | 63-72461 | A | 4/1988 |
| JP | 2-38155 | U | 3/1990 |
| JP | 4-9261 | A | 1/1992 |
| WO | WO-2005/003540 | A1 | 1/2005 |

*Primary Examiner* — Kuang Lin
(74) *Attorney, Agent, or Firm* — Global IP Counselors, LLP

(57) ABSTRACT

In a cylinder block manufacturing method, first and second dies and a liner support are provided to form a liner overcast configuration. The first and second dies are positioned with respect to the liner support and a dummy cylinder liner made of an aluminum alloy such that the first die contacts a pressing section of a first axial end of the liner support and a first axially facing end of the dummy cylinder liner, and the second die contacts a second axial end of the liner support and a second axially facing end of the dummy cylinder liner. The first and second dies are preheated to a prescribed temperature with the dummy cylinder liner positioned on the liner support by injecting molten aluminum alloy into a cylinder block molding cavity to form a dummy cylinder block with the dummy cylinder liner casted in the dummy cylinder block.

7 Claims, 15 Drawing Sheets

CYLINDER BLOCK MANUFACTURING METHOD, DUMMY CYLINDER LINER, AND DUMMY CYLINDER LINER CASTING METHOD

CROSS-REFERENCE TO RELATED APPLICATIONS

This application claims priority to Japanese Patent Application No. 2009-088079, filed on Mar. 31, 2009. The entire disclosure of Japanese Patent Application No. 2009-088079 is hereby incorporated herein by reference.

BACKGROUND

1. Field of the Invention

The present invention relates to a cylinder block manufacturing method, a dummy cylinder liner, and a dummy cylinder liner manufacturing method.

2. Background Information

There is an existing cylinder block manufacturing method for manufacturing an aluminum alloy cylinder block having a cast-in iron-based cylinder liner (e.g., International Patent Publication No. WO2005/003540). In the cylinder block manufacturing method presented in International Patent Publication No. WO2005/003540, a cavity is formed between an end face of a deck surface side of a cylinder liner and a movable die and molten aluminum alloy is injected into the cavity. The entire cylinder liner, including the end face on the deck surface side thereof, is covered by the molten aluminum alloy material. This method serves to manufacture a so-called "overcasting type" cylinder block. When manufacturing a cylinder block, it is necessary to include a preheating step to heat the dies to a prescribed temperature in order to achieve good circulation of the molten metal. When manufacturing an aluminum alloy cylinder block having a cast-in iron-based cylinder liner, recycling of material used in the dummy cylinder block cast in the preheating step becomes a problem. In other words, in order to re-melt the dummy cylinder block as recycled material, it is necessary to remove the iron-based cylinder liner from the aluminum alloy dummy cylinder block. In order to avoid the step of removing the iron-based cylinder liner, the idea of using an aluminum alloy cylinder liner in the preheating step has been proposed (e.g., Japanese Laid-open Patent Publication No. 04-9261).

SUMMARY

Aluminum alloys are comparatively expensive. Moreover, when manufacturing an overcasting type cylinder block, it is necessary to apply a machining process to the cylinder liner in order to prevent molten metal from entering between an internal circumferential surface of the cylinder liner and a liner support used to hold the cylinder liner during casting. Consequently, it has been more difficult to reduce the manufacturing cost than originally anticipated.

The object of the present invention is to provide a cylinder block manufacturing method, a dummy cylinder liner, and a dummy cylinder liner casting method that can reduce the cost of manufacturing a cylinder block.

A cylinder block manufacturing method according to a first aspect of the invention includes the following procedures: providing a first die that forms a portion of a deck surface molding cavity of a cylinder block molding cavity; providing a second die that forms a portion of a crank chamber molding cavity of the cylinder block molding cavity; providing a liner support including a shaft section and a pressing section that protrudes from the shaft section in a step-like manner so as to have a larger diameter than the shaft section for forming a liner overcast configuration; positioning a dummy cylinder liner that is made of an aluminum alloy on the liner support; positioning the first and second dies with respect to the liner support and the dummy cylinder liner such that the first die contacts the pressing section of a first axial end of the liner support and a first axially facing end of the dummy cylinder liner, and such that the second die contacts a second axial end of the liner support that is opposite to the first axial end of the liner support and a second axially facing end of the dummy cylinder liner that is opposite the first axially facing end of the dummy cylinder liner; preheating the first and second dies to a prescribed temperature with the dummy cylinder liner positioned on the liner support by injecting molten aluminum alloy into cylinder block molding cavities, which are formed with the first and second dies being closed, to form a dummy cylinder block with the dummy cylinder liner casted in the dummy cylinder block; removing the dummy cylinder block with the dummy cylinder liner casted in the dummy cylinder block from the liner support and the first and second dies; positioning an iron-based cylinder liner on the liner support after the first and second dies have reached the prescribed temperature by the preheating of the first and second dies such that the shaft section of the liner support contacts an internal circumferential surface of the iron-based cylinder liner; positioning the first and second dies with respect to the liner support and the iron-based cylinder liner such that the first die contacts the pressing section of the liner support, such that the pressing section contacts against a portion of a first axially facing end of the iron-based cylinder liner with the deck surface cavity formed between the first die and a first axially facing end of the iron-based cylinder liner, such that the second die contacts the second axial end of the liner support, and such that a second axially facing end of the iron-based cylinder liner contacts the second die; and injecting a molten aluminum alloy into the cylinder block molding cavities, which are formed with the first and second dies being closed, to form a cylinder block with the iron-based cylinder liner casted in the cylinder block and such that the aluminum alloy overlies the first axially facing end of the iron-based cylinder liner to overcast the first axially facing end of the iron-based cylinder liner.

In a die preheating step of a cylinder block manufacturing method according to the first aspect of the present invention, the molten metal is injected while the dummy cylinder liner is pinched between the first die and the second die. Consequently, molten metal does not flow in-between the liner support and an internal circumferential surface of the dummy cylinder liner. More specifically, molten metal does not flow in-between the liner support and an internal circumferential surface of the dummy cylinder liner even if the internal circumferential surface of the dummy cylinder liner has not been machined. Since it is not necessary to machine the dummy cylinder liner, the cost of manufacturing a cylinder block can be reduced. Since the dummy cylinder liner is made of the same aluminum alloy as the molten metal, the task of recycling the dummy block cast during the die preheating step can be accomplished more efficiently. In other words, it is not necessary to separate the cylinder liner (dummy cylinder liner) from the dummy cylinder block when the dummy cylinder block is re-melted as recycled material. The deck surface mentioned here refers to a surface of the cylinder block onto which a cylinder head will be mounted.

In a cylinder block manufacturing method according to a second aspect of the present invention, the positioning of the dummy cylinder liner on the liner support may be performed with the dummy cylinder liner being an unfinished raw casting. By using a dummy cylinder liner provided in the form of an unfinished raw casting, the cost of manufacturing a cylinder block can be reduced.

In a cylinder block manufacturing method according to a third aspect of the present invention, the dummy cylinder liner may have an internal bore with a tapered shape such that a first internal diameter of the dummy cylinder liner at the first axially facing end is substantially equal to an external diameter of the pressing section of the liner support to circumferentially overlie the pressing section, and such that a second internal diameter of the dummy cylinder liner at the second axially facing end is substantially equal to an external diameter of the shaft section of the liner support to circumferentially overlie the shaft section. In this way, seals can be formed between the dummy cylinder liner and the first and second dies and seals can be formed between the pressing section and an internal circumferential surface of the dummy cylinder liner and between the shaft section and an internal circumferential surface of the dummy cylinder liner. As a result, molten metal can be better prevented from flowing in-between the liner support and an internal circumferential surface of the dummy cylinder liner.

In a cylinder block manufacturing method according to a fourth aspect of the present invention, the dummy cylinder liner may include a mark formed in a position closer to one of the first and second axially facing ends. In this way, the dummy cylinder liner can be prevented from being installed onto the liner support in the wrong direction.

In a cylinder block manufacturing method according to a fifth aspect of the present invention, the mark formed on the dummy cylinder liner may be a groove. In this way, the installation direction of the dummy cylinder liner can be ascertained by means of a simple feature.

In a cylinder block manufacturing method according to a sixth aspect of the present invention, the mark may be formed on the dummy cylinder liner by a die during casting of the dummy cylinder liner. In this way, the marker can be formed easily. As a result, the cost of manufacturing a cylinder block can be reduced.

In a cylinder block manufacturing method according to a seventh aspect of the present invention, the positioning of the dummy cylinder on the liner support, the positioning the first and second dies with respect to the liner support and the dummy cylinder liner, the preheating of the first and second dies and the removing of the dummy cylinder block may be performed a plurality of times until the first and second dies reach a prescribed temperature. In this way, the temperature of the dies can be increased with greater certainty.

A dummy cylinder liner according to an eighth aspect of the present invention is adapted to be cast into a dummy cylinder block during preheating of a plurality of dies configured and arranged to cast a cylinder block having a cast-in iron-based cylinder liner. The dies includes a first die configured to form a portion of a deck surface molding cavity of a cylinder block molding cavity, a second die configured to form a portion of a crank chamber molding cavity of the cylinder block molding cavity, and a liner support having a shaft section configured to hold the iron-based cylinder liner by contacting an internal circumferential surface of the iron-based cylinder liner and a pressing section that protrudes from the shaft section in a step-like manner so as to have a larger diameter than the shaft section and arranged to press against a portion of a first axially facing end of the iron-based cylinder liner, the liner support being provided on the first die such that the pressing section is on the first die side and the liner support protrudes toward the second die. The cylinder block having the cast-in iron-based cylinder liner is cast by injecting a molten aluminum alloy into a cylinder block molding cavities, which are formed with the first and second dies being closed, to form a cylinder block with the iron-based cylinder liner casted in the cylinder block and such that the aluminum alloy overlies the first axially facing end of the iron-based cylinder liner to overcast the first axially facing end of the iron-based cylinder liner. The dummy cylinder liner includes a tubular main body made of an aluminum alloy having an axial length longer than an axial length of the iron-based cylinder liner such that the tubular main body can be pinched between the first die and the second die, an internal diameter of the tubular main body of the dummy cylinder liner at a first axial end being at least as large as an external diameter of the pressing section of the liner support.

Since a dummy cylinder liner according to the eighth aspect of the present invention is formed to be longer in an axial direction than an iron-based cylinder liner, mold clamping (closing) can be accomplished with the dummy cylinder liner pinched between the first and second dies (which constitute a mold) during a die preheating step executed before a so-called "overcasting" type cylinder block is cast by injecting a molten aluminum alloy into a deck surface molding cavity formed between an end face of a deck surface side of an iron-based cylinder liner and the first die (which forms a portion of the deck surface molding cavity) such that the entire cylinder liner (including the end face on the deck surface side) is covered by molten metal.

During the die preheating step, both axially facing end faces of the dummy cylinder liner serve to form seals preventing molten metal from flowing in-between the liner support holding the dummy cylinder liner and an internal circumferential surface of the dummy cylinder liner. Consequently, it is not necessary to provide a separate seal between the liner support and the internal circumferential surface of the dummy cylinder liner. Thus, it is not necessary to machine the internal circumferential surface of the dummy cylinder liner. As a result, the manufacturing cost can be reduced. Additionally, the structure of the dummy cylinder liner is simple because it is merely made to have a longer axial length than the iron-based cylinder liner used in an actual cylinder block product (non-dummy cylinder block) and to have an internal diameter at one axially facing end that is larger than an external diameter of the pressing section. Since the dummy cylinder liner is made of the same aluminum alloy as the molten metal, the task of recycling the dummy block cast during the die preheating step can be accomplished more efficiently. In other words, it is not necessary to separate the dummy cylinder liner from the dummy cylinder block when the dummy cylinder block is re-melted as recycled material.

A dummy cylinder liner casting method according to a ninth aspect of the present invention is for casting a dummy cylinder liner adapted to be cast into a dummy cylinder block during preheating of a plurality of dies configured and arranged to cast a cylinder block having a cast-in iron-based cylinder liner. The dies include a first die configured to form a portion of a deck surface molding cavity of a cylinder block molding cavity, a second die configured to form a portion of a crank chamber molding cavity of the cylinder block molding cavity, and a liner support having a shaft section configured to hold the iron-based cylinder liner by contacting an internal circumferential surface of the iron-based cylinder liner and a pressing section that protrudes from the shaft section in a step-like manner so as to have a larger diameter than the shaft section and arranged to press against a portion of a first axially facing end of the iron-based cylinder liner, the liner support being provided on the first die such that the pressing section is on the first die side and the liner support protrudes toward the second die. The cylinder block having the cast-in iron-based cylinder liner is cast by injecting a molten aluminum alloy into a cylinder block molding cavity, which are formed with the first and second dies being closed, to form a cylinder block with the iron-based cylinder liner casted in the cylinder block and such that the aluminum alloy overlies the first axially facing end of the iron-based cylinder liner to overcast the first axially facing end of the iron-based cylinder liner. The dummy cylinder liner casting method includes: providing a mold having a tubular mold cavity with an axial length of the tubular mold cavity being longer than an axial length of the iron-based cylinder liner and an internal diameter of the tubular mold cavity at a first axial end being at least as large as an external diameter of the pressing section of the liner support; and injecting a molten aluminum alloy into the tubular mold cavity of the mold to form the dummy cylinder liner.

Since a dummy cylinder liner made using a dummy cylinder liner casting method according to a ninth aspect of the present invention is formed to be longer in an axial direction than an iron-based cylinder liner, mold clamping can be accomplished with the dummy cylinder liner pinched between the first and second dies (which constitute a mold) during a die preheating step executed before a so-called "overcasting" type cylinder block is cast by injecting a molten aluminum alloy into a deck surface molding cavity formed between an end face of a deck surface side of an iron-based cylinder liner and the first die (which forms a portion of the deck surface molding cavity) such that the entire iron-based cylinder liner (including the end face on the deck surface side) is covered by molten metal. With this method, both axially facing end faces of the dummy cylinder liner serve to form seals preventing molten metal from flowing in-between the liner support holding the dummy cylinder liner and an internal circumferential surface of the dummy cylinder liner. Consequently, it is not necessary to provide a separate seal between the liner support and the internal circumferential surface of the dummy cylinder liner. Thus, it is not necessary to machine the internal circumferential surface of the dummy cylinder liner. As a result, the cost of manufacturing a cylinder block can be reduced. Additionally, the structure of the dummy cylinder liner is simple because it is merely made to have a longer axial length than the iron-based cylinder liner used in an actual cylinder block product (non-dummy cylinder block) and to have an internal diameter at one axially facing end that is larger than an external diameter of the pressing section. Since the dummy cylinder liner is made of the same aluminum alloy as the molten metal, the task of recycling the dummy block cast during the die preheating step can be accomplished more efficiently. In other words, it is not necessary to separate the dummy cylinder liner from the dummy cylinder block when the dummy cylinder block is re-melted as recycled material.

Additionally, in a dummy cylinder liner casting method according to a tenth aspect of the present invention, the providing of the mold may include providing the mold with the tubular mold cavity having such a tapered shape that a first internal diameter of the tubular mold cavity at the first axial end is substantially equal to an external diameter of the pressing section of the liner support and a second internal diameter of the tubular mold cavity at a second axial end is substantially equal to an external diameter of the shaft section of the liner support. In this way, during a die preheating step serving to raise a temperature of the dies, seals can be formed between the dummy cylinder liner and the first and second dies and seals can be formed between the pressing section and an internal circumferential surface of the dummy cylinder liner and between the shaft section and an internal circumferential surface of the dummy cylinder liner. As a result, molten metal can be better prevented from flowing in-between the liner support and an internal circumferential surface of the dummy cylinder liner. As a result, the production of bad parts can be suppressed and the cost of manufacturing a cylinder block can be further reduced.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
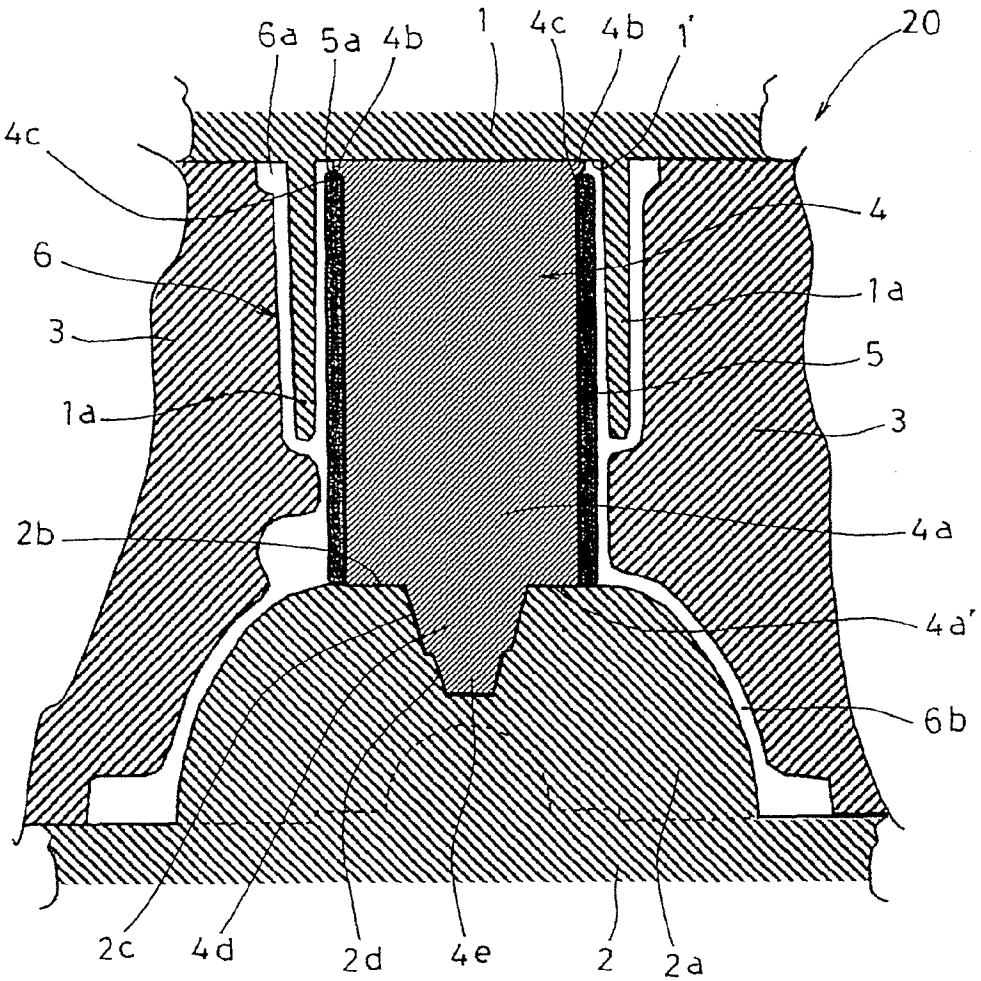
FIG. 1 is a schematic view showing an example of a casting apparatus 20 used in a cylinder block manufacturing method according to an embodiment of the present invention.

FIG. 1 is a schematic view showing an example of a casting apparatus 20 used in a cylinder block manufacturing method according to an embodiment of the present invention. The casting apparatus 20 includes a mold comprising a moveable die 1, a stationary die 2, a moveable core 3, and a liner support 4 fixed to the moveable die 1. In FIG. 1, a iron-based cylinder liner 5 is installed on the liner support 4 in preparation for casting a cylinder block having a cast-in iron-based cylinder liner 5.

The moveable die 1 forms a portion of a deck surface molding cavity 6*a* for molding a deck surface of an end-product cylinder block and has a jacket molding wall section 1*a* for molding a water jacket in the end-product cylinder block. The deck surface mentioned here refers to a surface of the cylinder block onto which a cylinder head will be mounted. The jacket molding wall section 1*a* is generally cylindrical and extends from the moveable die 1 such that it can surround a portion of the iron-based cylinder liner 5 when the iron-based cylinder liner 5 is mounted on the liner support 4. The jacket molding wall section 1*a* is configured and arranged such that it surrounds the iron-based cylinder liner 5 with a prescribed space (cavity) in-between the jacket molding wall section 1*a* and the iron-based cylinder liner 5.

The stationary die 2 forms a portion of a crank chamber molding cavity 6*b* for molding a crank chamber in the end-product cylinder block and has a bulged section 2*a* for molding the crank chamber in the end-product cylinder block. A flat surface 2*b* is formed on a peak portion of the bulged section 2*a*, a large recess 2*c* having a trapezoidal cross sectional shape is formed in a center portion of the flat surface 2*b*, and a small recess 2*d* having a trapezoidal cross sectional shape is formed in a center portion of the large recess 2*c* such that a step like transition exists between the large recess 2*c* and the small recess 2*d*. Although not shown in the drawings, the large recess 2*c* is formed as a groove extending along a direction in which the cylinders are arranged in the end-product cylinder block and the small recess 2*d* is formed as a conical hole.

The liner support 4 comprises a substantially solid cylindrical shaft section 4*a* and a pressing section 4*b* having a larger diameter than the shaft section 4*a*. The pressing section 4*b* is fixed to a mounting surface 1' of the moveable die 1 and protrudes from the moveable die 1. A step-like transitional section 4*c* is formed between the shaft section 4*a* and the pressing section 4*b*. A large protrusion 4*d* having a trapezoidal cross sectional shape is formed on a tip end 4*a*' (i.e., opposite end as the end where the pressing section 4*b* is arranged) of the shaft section 4*a*. A small protrusion 4*e* having a trapezoidal cross sectional shape is formed on center portion of the large protrusion 4*d* such that a step-like transition exists between the large protrusion 4*d* and the small protrusion 4*e*. Although not shown in the drawings, the large protrusion 4*d* is formed as an elongated protrusion extending along a direction in which the cylinders are arranged in the end-product cylinder block and the small protrusion 4*e* is formed as a conical projection.

Figure 2:
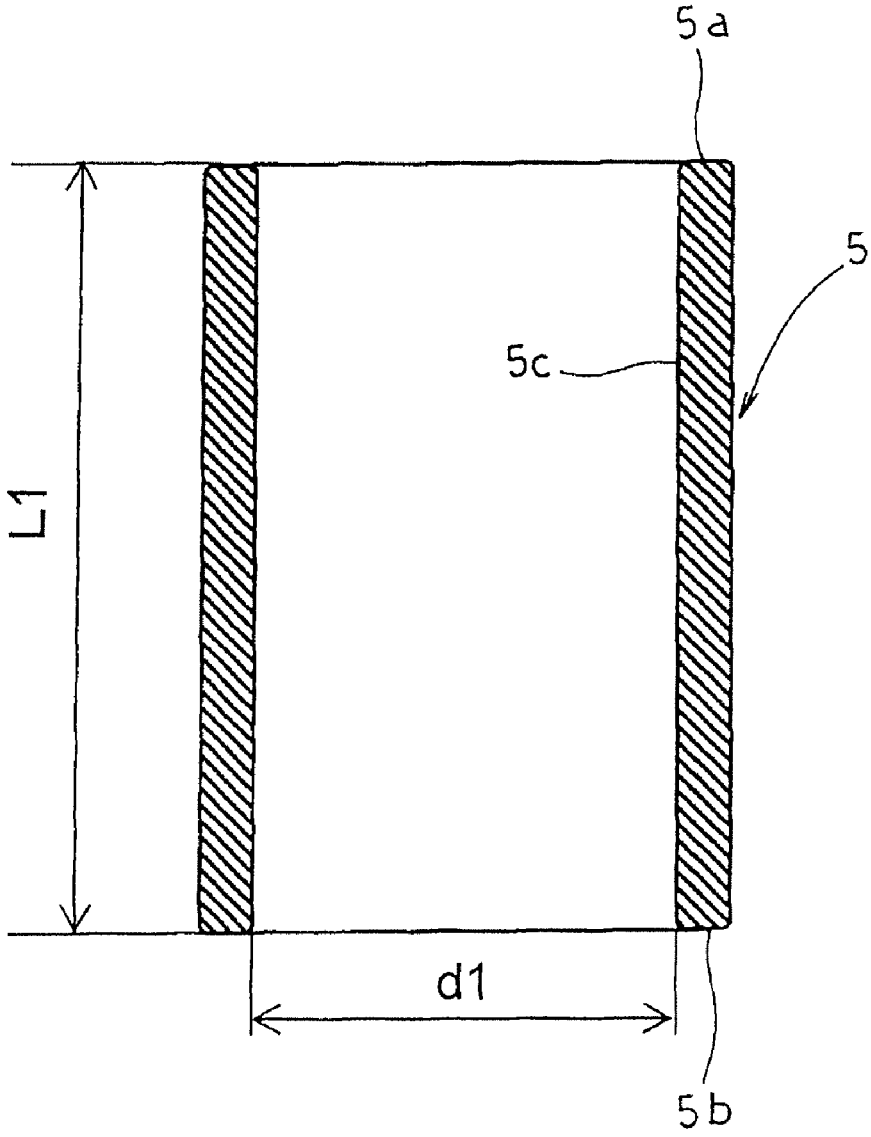
FIG. 2 is a cross sectional view of a iron-based cylinder liner 5.

FIG. 2 is a cross sectional view of a iron-based cylinder liner 5. As shown in FIG. 2, the iron-based cylinder liner 5 is formed as a cylinder having uniform internal and external diameters along its axial length. The internal diameter d1 of the iron-based cylinder liner 5 is substantially the same as an external diameter of the shaft portion 4*a* of the liner support 4 and the axial length L1 of the iron-based cylinder liner 5 is substantially the same as the length of a portion of the liner support 4 spanning from the transitional section 4*c* to the tip end 4*a*' of the shaft section 4*a*. The iron-based cylinder liner 5 is made of wear resistant cast iron.

Figure 3:
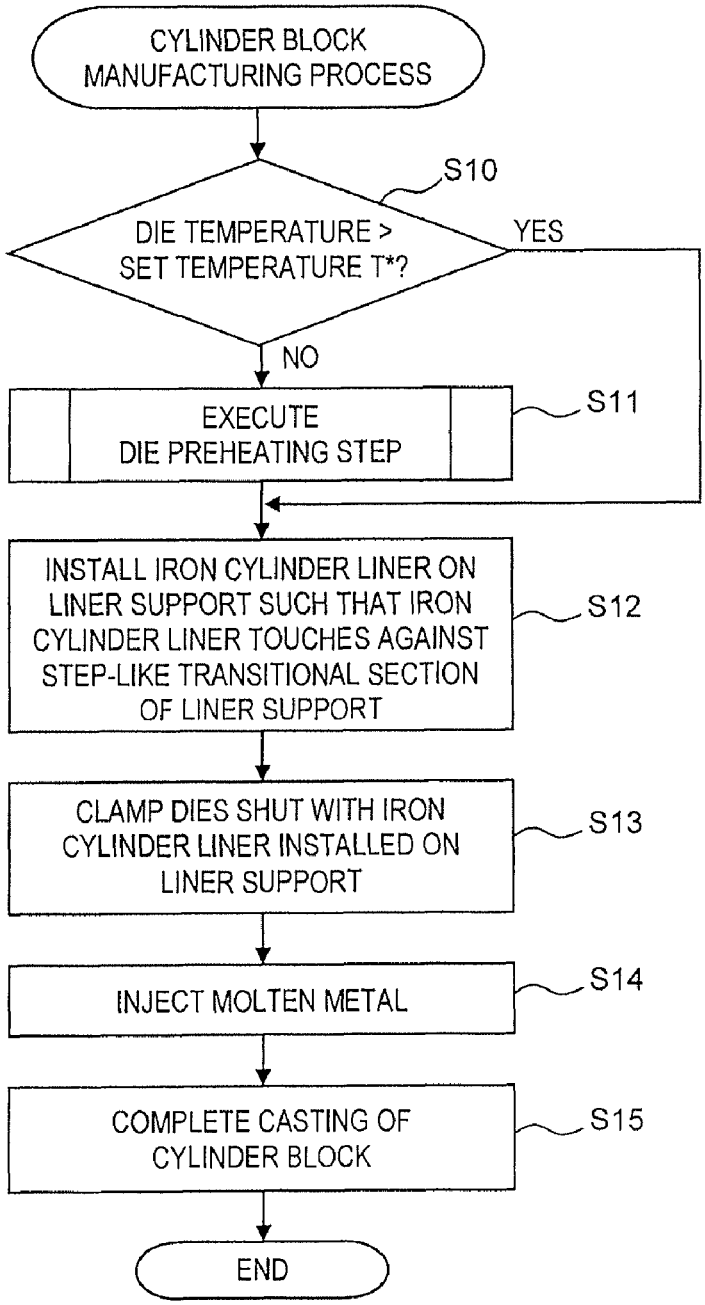
FIG. 3 is a flowchart explaining an example of a process for manufacturing a cylinder block having a cast-in iron-based cylinder liner 5.
Figure 4:
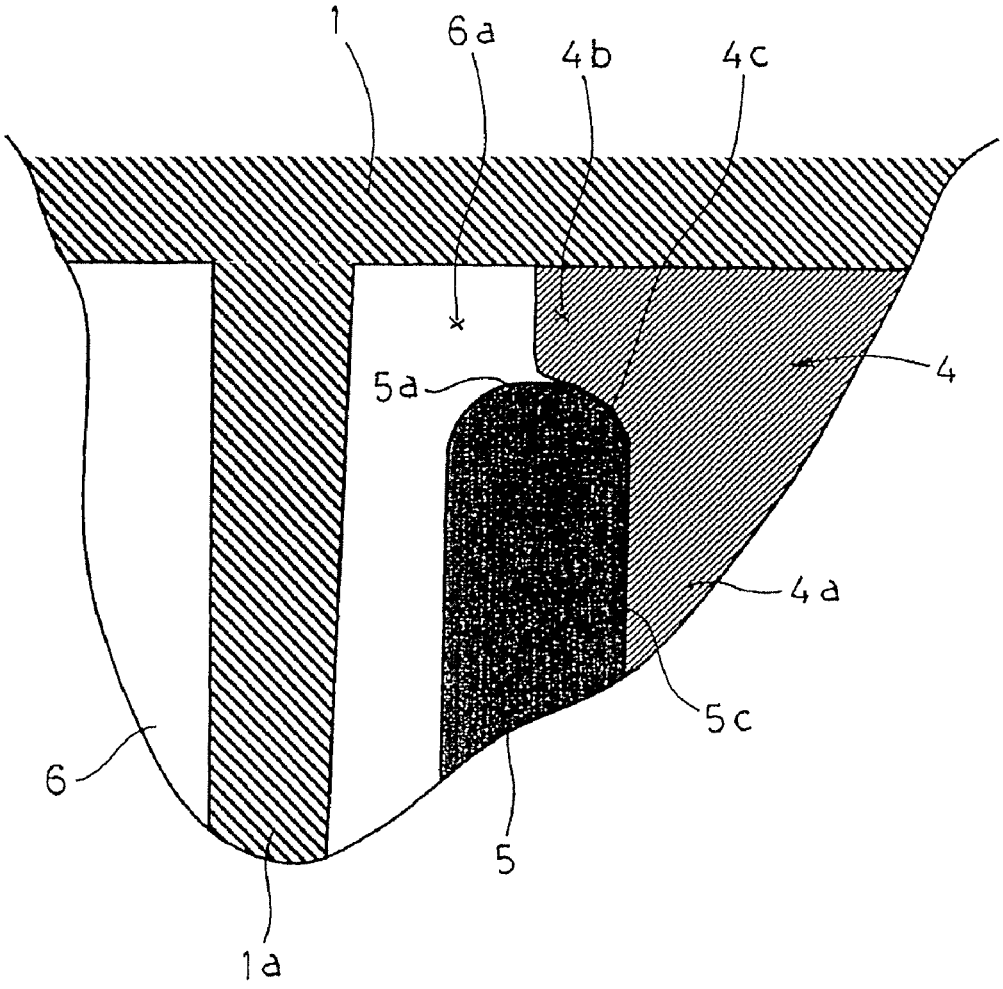
FIG. 4 is an enlarged view showing the iron-based cylinder liner 5 installed on a liner support 4 with dies clamped shut.

A process by which a cylinder block having a cast-in iron-based cylinder liner 5 is manufactured using the casting apparatus 20 will now be explained. FIG. 3 is a flowchart explaining an example of a process for manufacturing a cylinder block having a cast-in iron-based cylinder liner 5, and FIG. 4 are enlarged views showing the iron-based cylinder liner 5 installed on the liner support 4 with the dies clamped.

Figure 5:
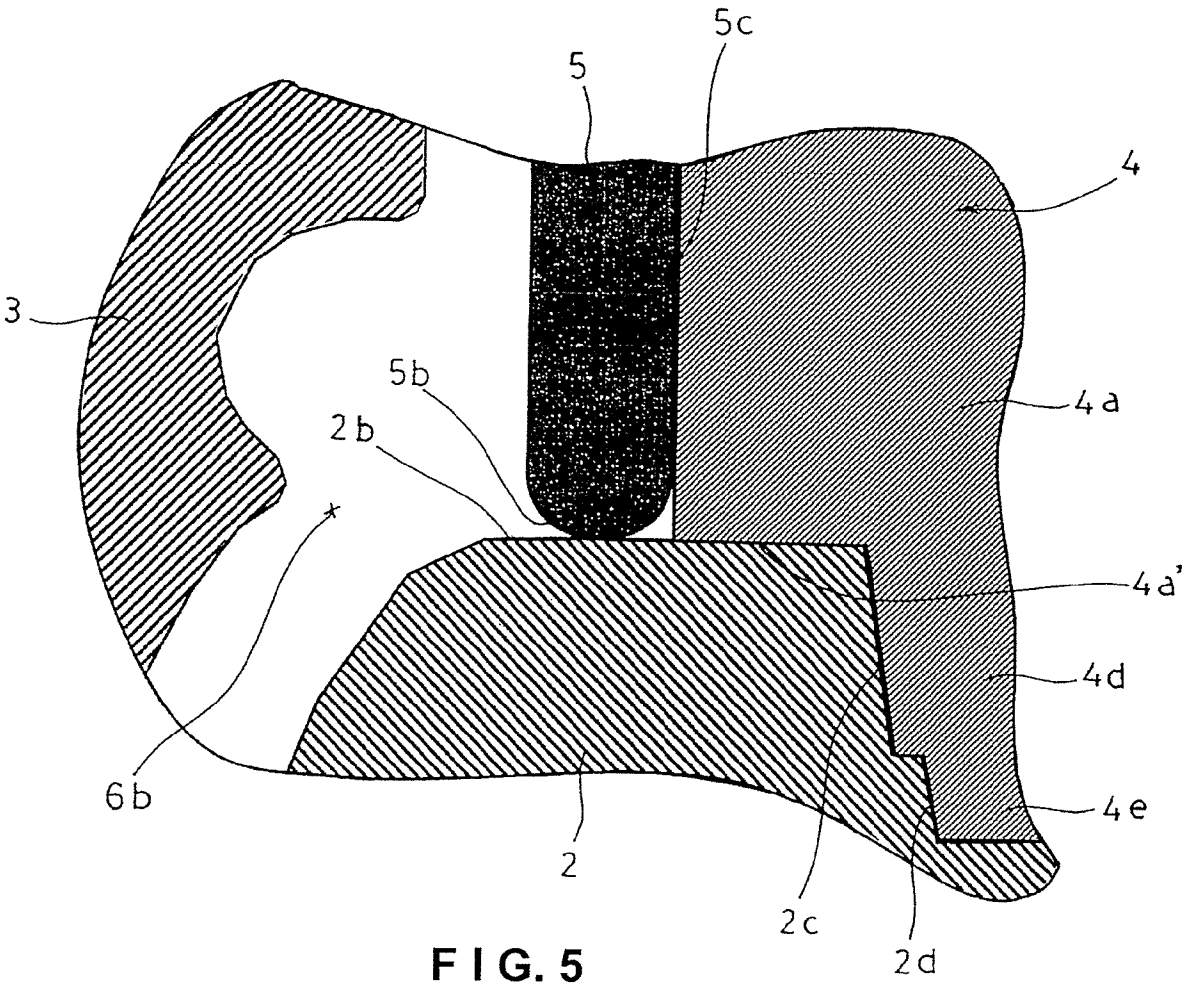
FIG. 5 is an enlarged view showing the iron-based cylinder liner 5 installed on a liner support 4 with dies clamped shut.

In order to manufacture a cylinder block having a cast-in iron-based cylinder liner 5, whether a temperature of the dies is higher than a set temperature T* (prescribed temperature) is first determined (step S10). If the temperature of the dies is not higher than the set temperature T*, a die preheating step is executed (step S11) to heat the dies to the set temperature T*. Then, the iron-based cylinder liner 5 is mounted on the liner support 4 (step S12) and the moveable die 1, the stationary die 2, and the moveable core 3 are clamped shut with the iron-based cylinder liner 5 mounted on the inner support 4 (step S13). As shown in FIGS. 4 and 5, the iron-based cylinder liner 5 is arranged such that one end 5*a* touches against the step-like transitional section 4*c* of the liner support 4 and the other end 5*b* touches against the flat surface 2*b* of the bulged section 2*a* of the stationary die 2. In other words, the iron-based cylinder liner 5 is arranged such that it is pinched between the stationary die 2 and the step-like transitional section 4*c* of the liner support 4 when the dies are clamped. When the dies and the iron-based cylinder liner 5 are arranged as described above and the dies are clamped shut, a cylinder block molding cavity 6 comprising a deck surface molding cavity 6*a* and a crank chamber molding cavity 6*b* is formed inside the dies. A deck surface molding cavity 6*a* is also formed between the moveable die 1 and one end 5*a* of the iron-based cylinder liner 5.

Next, a molten aluminum alloy is injected into the cylinder block molding cavity 6 (step S14). The molten aluminum alloy does not flow in-between the iron-based cylinder liner 5 and the liner support 4 because of the good sealing achieved by the contact between one end 5*a* of the iron-based cylinder liner 5 and the step-like transitional section 4*c* of the liner support 4, the contact between the other end 5*b* of the iron-based cylinder liner 5 and the flat surface 2*b* of the bulged section 2*a* of the stationary die 2, and the contact between the internal circumferential surface 5*c* of the iron-based cylinder liner 5 and the external circumferential surface of the shaft section 4*a* of the liner support 4.

Finally, the molten aluminum alloy injected into mold is allowed to cool to complete the casting of a cylinder block having a cast-in iron-based cylinder liner 5 (step S15). After the molten metal has cooled, the moveable die 1, the stationary die 2, and the moveable core 3 are separated so that the cylinder block can be removed. The cylinder block obtained in this process is a so-called overcasting type cylinder block having a liner overcast configuration in which the entire external circumference of the iron-based cylinder liner 5, including the end 5*a*, is covered with an aluminum alloy.

If it is determined that the temperature of the dies is higher than the set temperature T* in step S10, then the manufacturing process of the cylinder block in steps S11 to S15 described above is executed without performing the preheating step in step S11. Therefore, in the cylinder block manufacturing method, a plurality of cylinder blocks can be sequentially manufactured using the preheated dies by repeating steps S11 to S15, once the dies are preheated to the set temperature T* in step S10 during an initial cycle of the manufacturing process. As used herein, the phrase "determining whether the temperature of the dies is higher than the set (prescribed) temperature" does not necessarily mean that an actual temperature of the dies needs to be measured in step S10. For example, whether the temperature of the dies is higher than the set temperature T* can be determined in step S10 by merely determining whether that cycle is an initial cycle in the manufacturing process (i.e., whether or not the dies have already preheated once in the manufacturing process). Therefore, it is not necessary to actually detect the temperature of the dies in step S10 in order to determine whether the temperature of the dies is higher than the set temperature T*.

Figure 7:
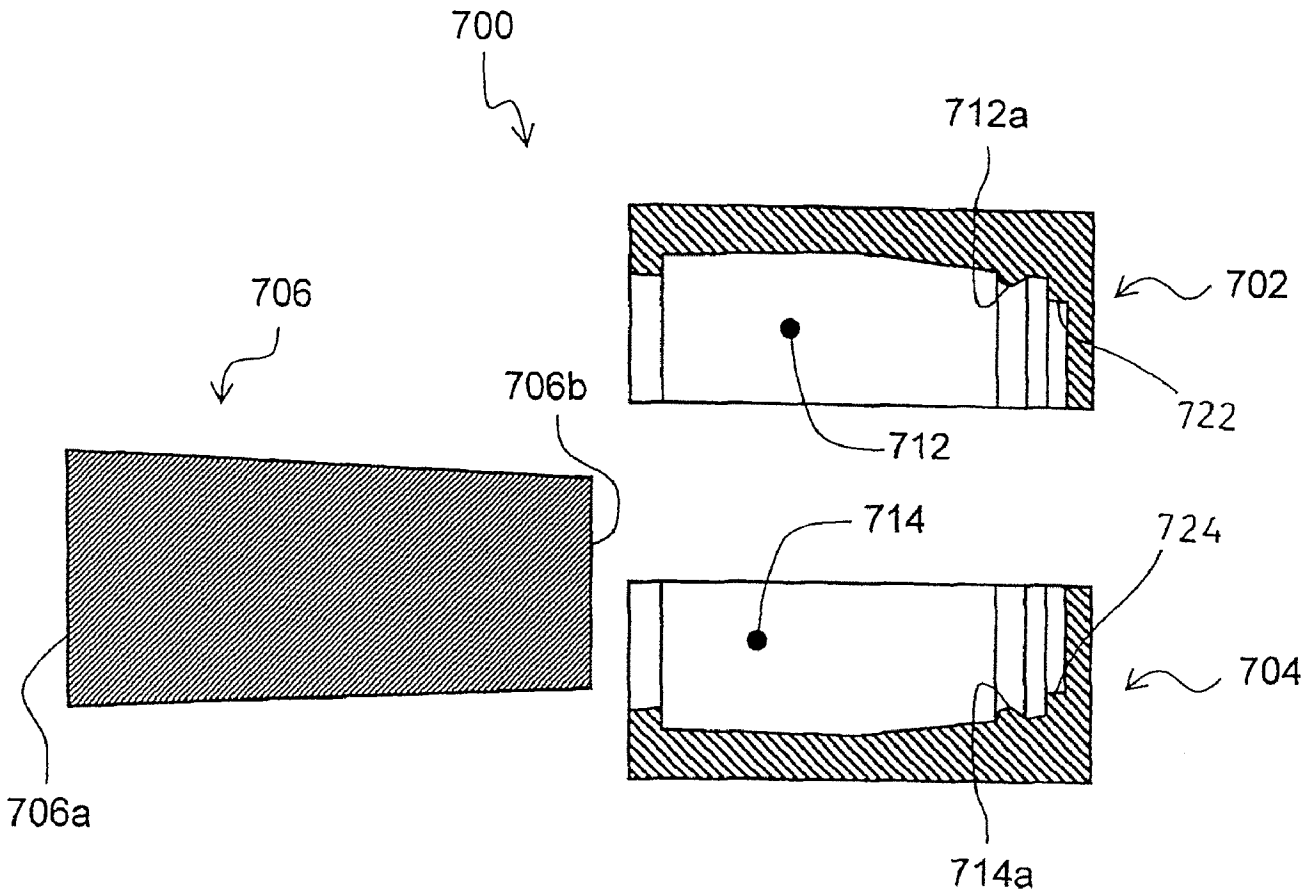
FIG. 7 is a schematic view showing constituent features of a mold 700 for molding a dummy cylinder liner 7.
Figure 8:
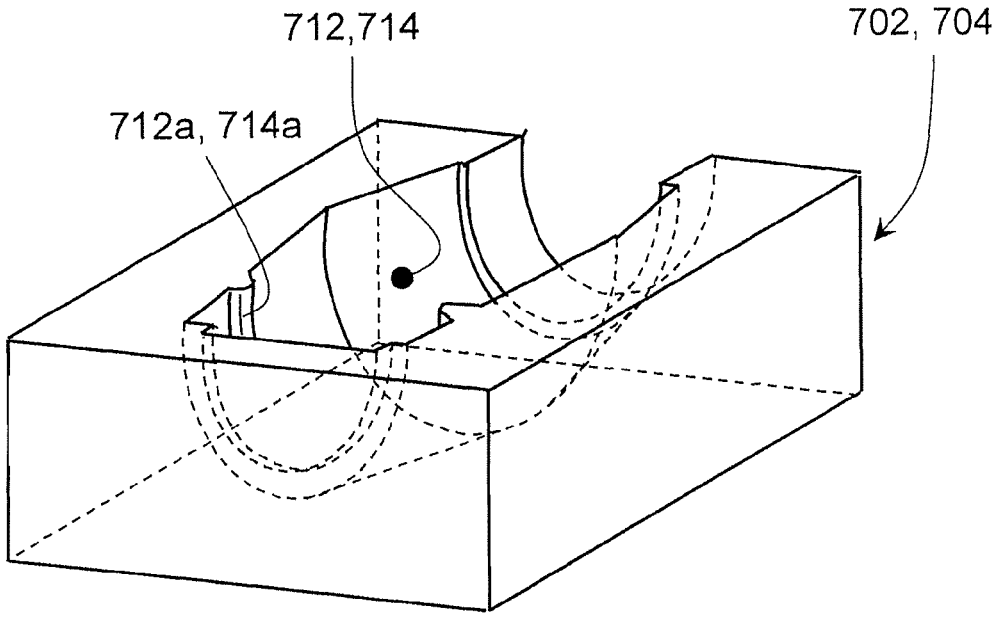
FIG. 8 is a perspective view showing an external appearance of a movable die 702 and a stationary die 704.

The die preheating step (step S11 of FIG. 4) will now be explained with reference to the flowchart shown in FIG. 6. In the die preheating step, a dummy cylinder liner 7 made of an aluminum alloy is used instead of the iron-based cylinder liner 5. Before explaining the die preheating step, the dummy cylinder liner 7 itself will be explained. FIG. 7 is a schematic view showing constituent features of a mold 700 for fabricating a dummy cylinder liner 7, FIG. 8 is a perspective view showing an external appearance of a movable die 702 and a stationary die 704, and FIG. 9 shows the mold 700 with the dies in a clamped state.

Figure 9:
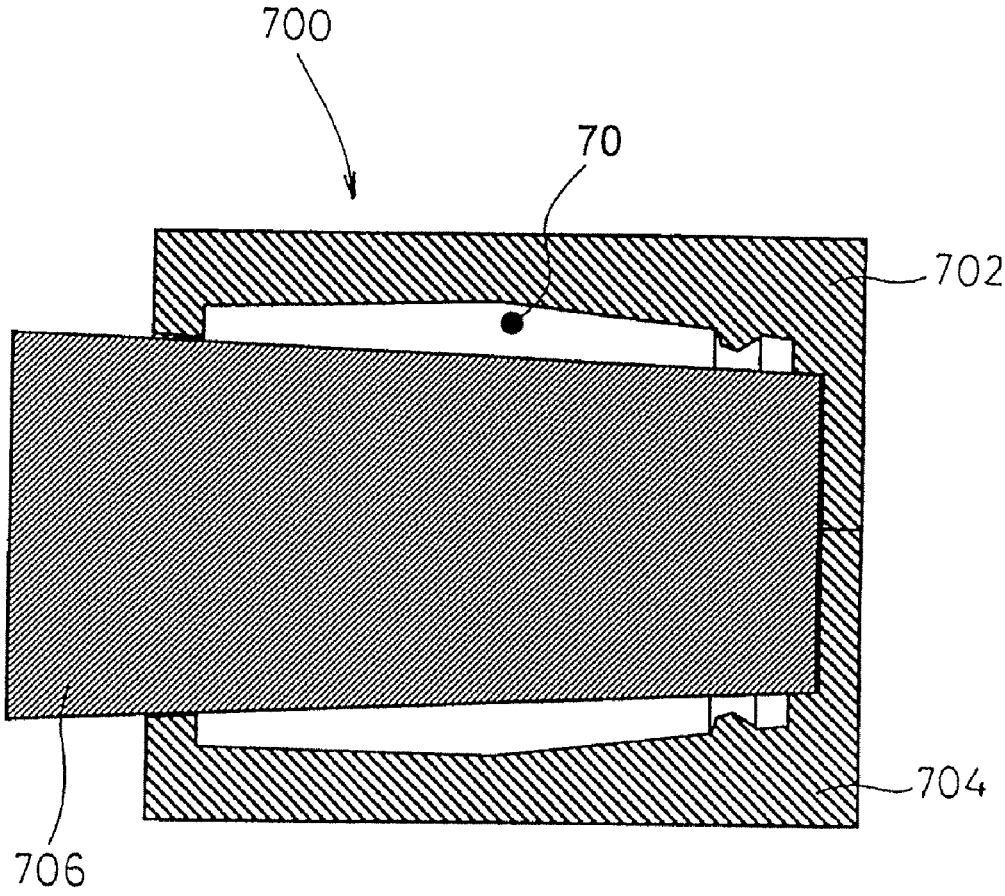
FIG. 9 shows the mold 700 with the dies in a clamped state.

As shown in FIGS. 7 and 9, the mold 700 comprises a moveable die 702, a stationary die 704, and a moveable core 706. When the moveable die 702 and the stationary die 704 are clamped shut with the moveable core arranged in-between, a cavity 70 for molding a dummy cylinder liner 7 is formed. As shown in FIG. 8, the moveable die 702 and the stationary die 704 have basically the same structure. Each has a recess 712 or 714 having a semicircular shape in a cross section taken perpendicularly to a lengthwise direction and a support recess 722 or 724 having a semicircular shape in a cross section taken perpendicularly to a lengthwise direction and configured to support the moveable core 706. The internal radius of each of the recesses 712 and 714 is larger in a lengthwise middle portion of the die 702 or 704 and gradually decreases as one moves toward either end in a lengthwise direction. A semicircular annular protrusion 712*a* or 714*a* is formed at one lengthwise end portion of each of the dies 702 and 704 and is configured to span across the entire semicircular internal circumference of the portion where it is formed. The protrusions 712*a* and 714*a* form a complete annular protrusion when the moveable die 702 and the stationary die 704 are fitted together. The moveable core 706 is tapered such that an external diameter thereof gradually decreases from one end 706*a* to the other 706*b*. The tapered shape of the moveable core 706 provides a sufficient draft angle for removing the moveable core 706 from the dummy cylinder liner 7 after molding. The external diameter of the one end 706*a* is set to be equal to an external diameter of the pressing section 4*b* of the liner support 4, and the external diameter of the other end 706*b* is set to be equal to an external diameter of the shaft section 4*a* of the liner support 4.

Figure 10:
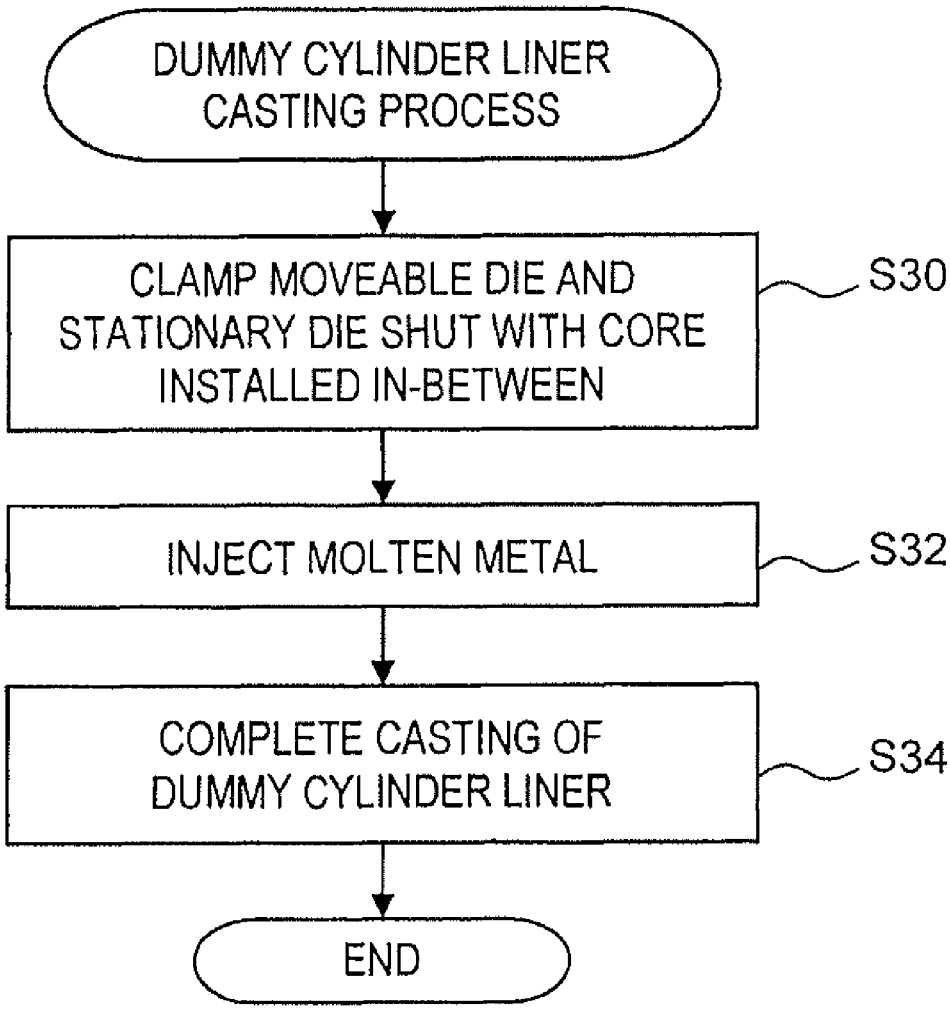
FIG. 10 is a flowchart explaining an example of a process for casting a dummy cylinder liner.

The process of fabricating a dummy cylinder liner 7 using the mold 700 described above will now be explained. FIG. 10 is a flowchart explaining an example of a process for casting a dummy cylinder liner. First, the moveable die 702 and the stationary die 704 are fitted together and clamped with the moveable core pinched in-between (step S30). Next, a molten aluminum alloy that is the same as the material from which the cylinder block will be made is injected into the cavity 70 formed inside the mold 700 (step S32). Finally, the molten metal injected into the mold 700 is allowed to cool to complete the casting of the dummy cylinder liner 7 (step S34). After the molten metal has cooled, the moveable die 702 and the stationary die 704 are opened and the moveable core 706 is removed so that the dummy cylinder liner 7 can be taken out. Since the moveable core 706 is tapered, it is easy to remove from the completed dummy cylinder liner 7.

Figure 11:
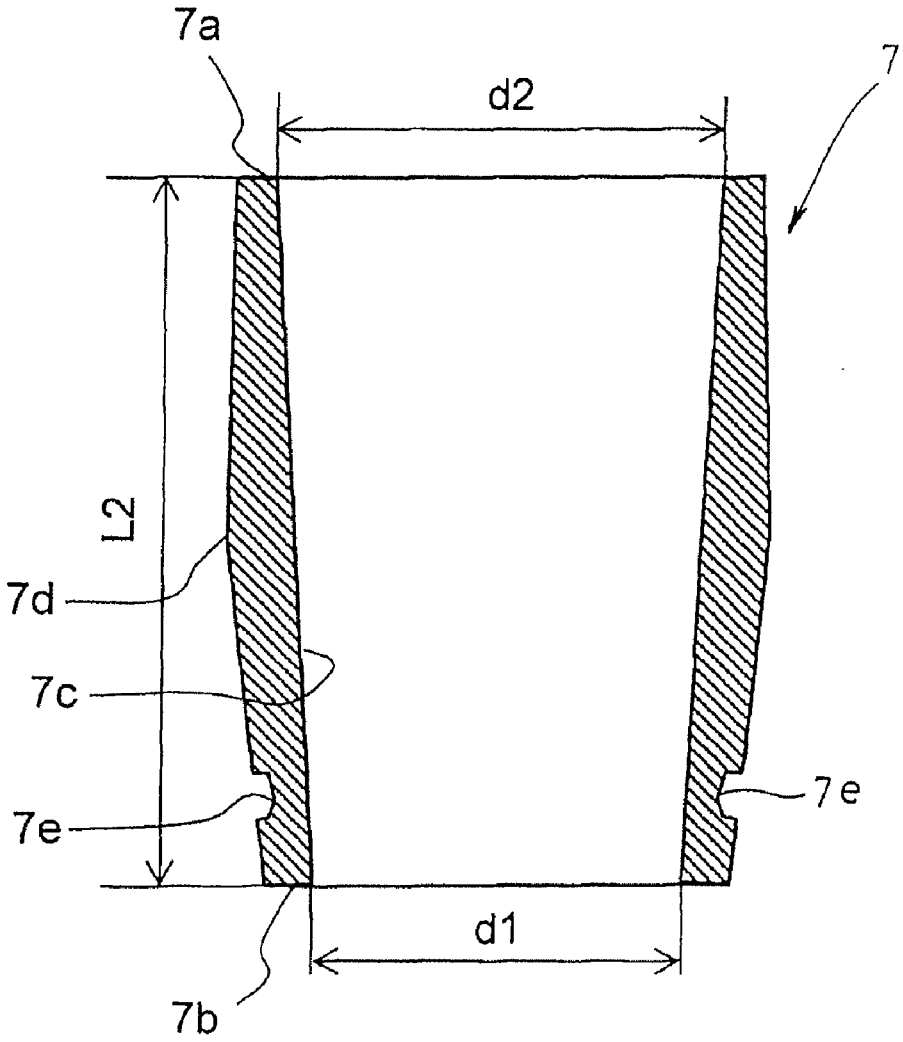
FIG. 11 is a cross sectional view of a dummy cylinder liner 7.
Figure 12:
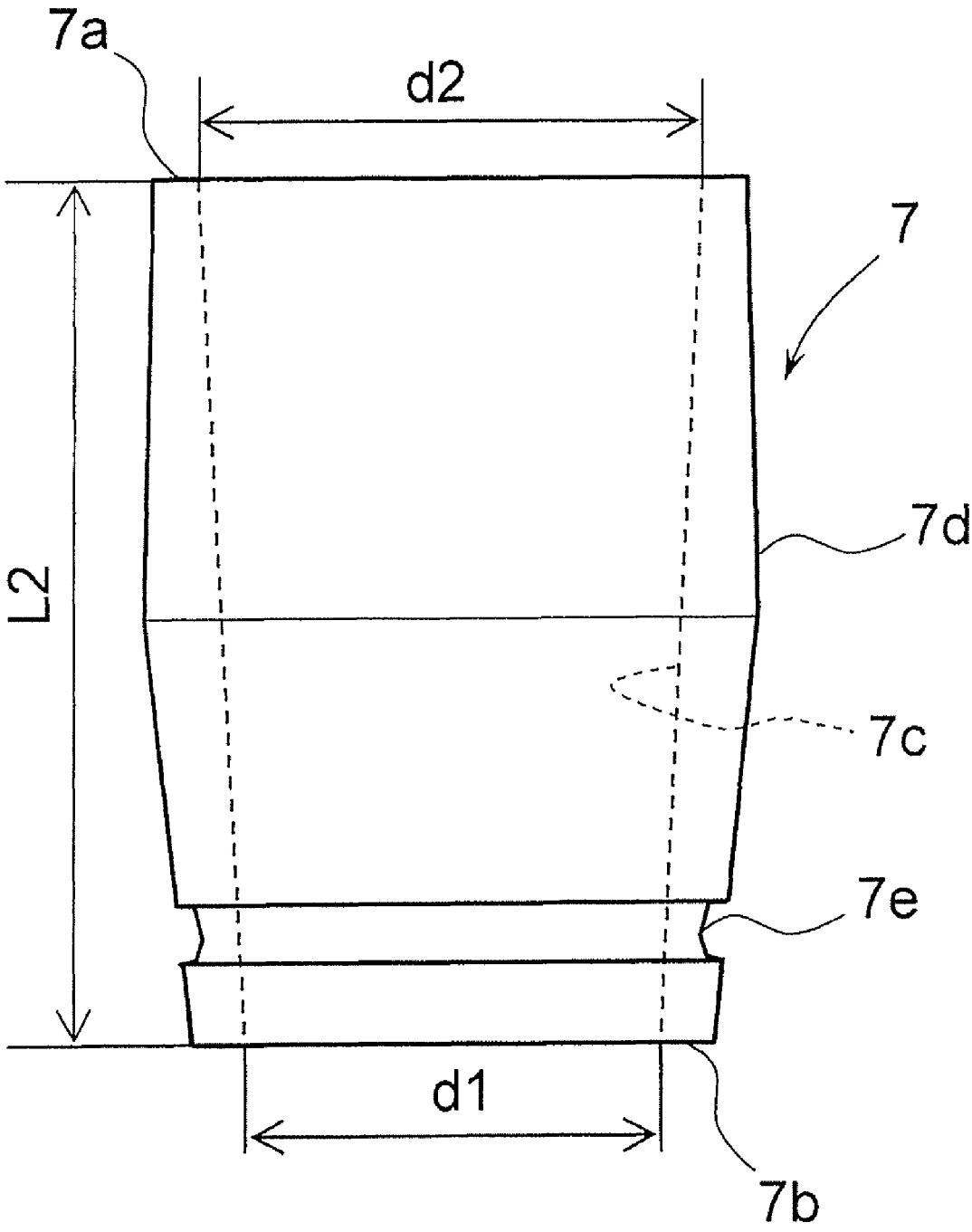
FIG. 12 is an external view an external appearance of a dummy cylinder liner 7.

As shown in the cross sectional view of a dummy cylinder liner 7 shown in FIG. 11 and the external view of a dummy cylinder liner 7 shown in FIG. 12, the dummy cylinder liner 7 is hollow and generally shaped like a barrel that tapers from an axially middle portion 7*d* such that its external diameter gradually decreases toward both ends 7*a* and 7*b*. The internal circumferential surface 7*c* of the dummy cylinder liner 7 is configured by the moveable core 706 to have a draft angle. Thus, the internal circumferential surface 7*c* of the dummy cylinder liner 7 is tapered such that an internal diameter d2 at one end 7*a* is larger than an internal diameter d1 at the other end 7*b*. The internal diameter d2 is the same as an external diameter of the pressing section 4*b* of the liner support 4, and the internal diameter d1 is the same as an external diameter of the shaft section 4*a* of the liner support 4. The axial length L2 of the dummy cylinder liner 7 is the same as the entire length of the liner support 4. Thus, the axial length L2 of the dummy cylinder liner 7 is equal to the distance between the mounting surface 1' where the liner support 4 is attached to the moveable die 1 and the flat surface 2*b* of the bulged section 2*a* of the stationary die 2 when the dies are clamped together. Additionally, the protrusions 712*a* and 714*a* of the moveable die 702 and the stationary die 704 form an annular groove 7*e* in an external circumferential surface of the dummy cylinder liner 7. The groove 7*e* spans completely around the external circumferential surface of the dummy cylinder liner 7 near the other end 7*b* of the dummy cylinder liner 7.

Figure 6:
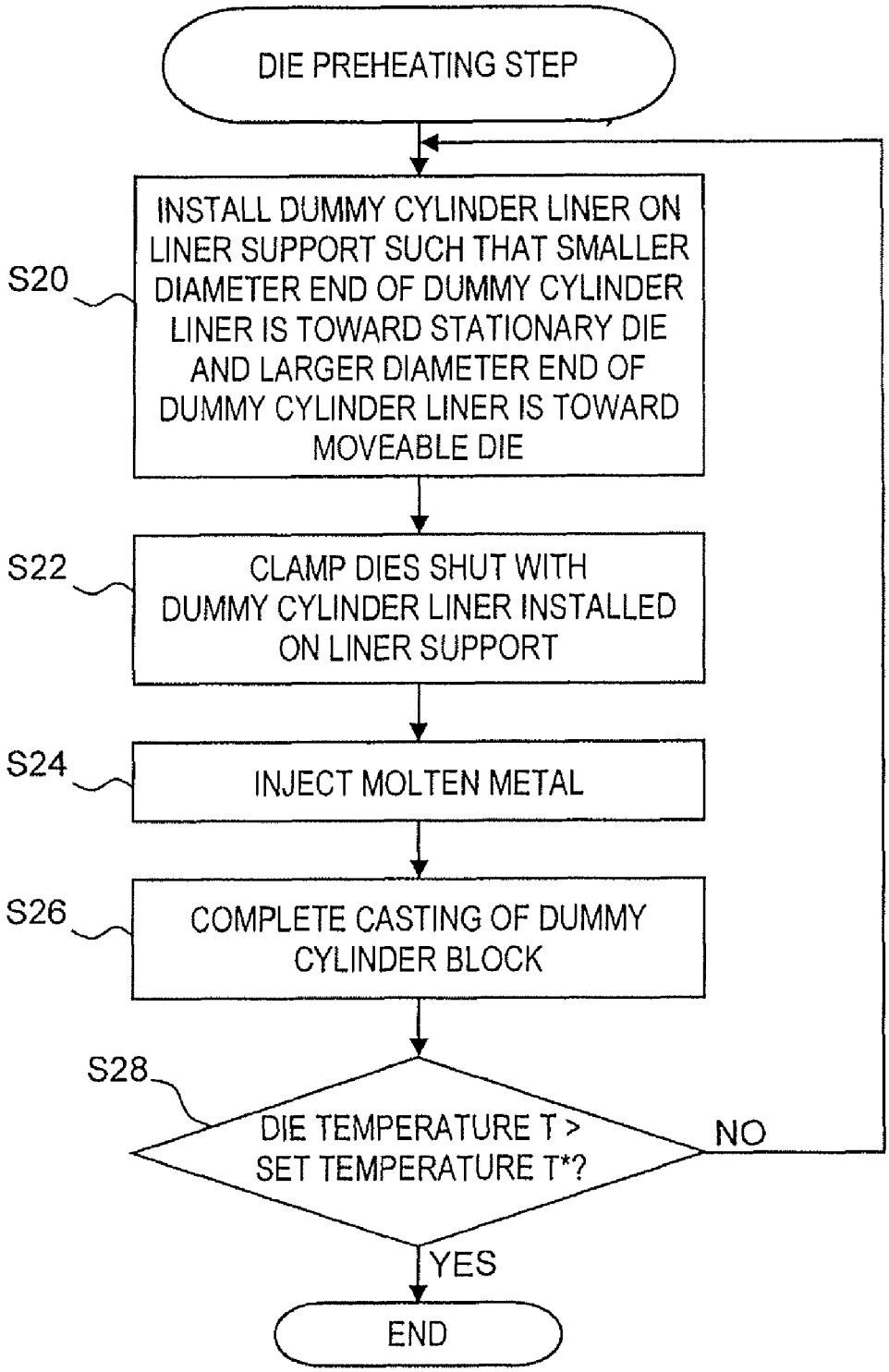
FIG. 6 is a flowchart explaining an example of a die preheating step executed in a cylinder block manufacturing method according to an embodiment of the present invention.

The explanation will now return to the die preheating step summarized in FIG. 6. A dummy cylinder liner 7 fabricated as described above is mounted onto the liner support 4 such that one end 7*a* is toward the moveable die 1 and the other end 7*b* is toward the stationary die 2 (step S20). Then, the moveable die 1, the stationary die 2, and the moveable core 3 are clamped shut with the dummy cylinder liner 7 installed on the liner support 4 (step S22). Since the internal diameter d2 of the one end 7*a* of the dummy cylinder liner 7 is equal to the external diameter of the pressing section 4*b* of the liner support 4 and the axial length L2 is equal to the full length of the liner support 4, the dummy cylinder liner 7 is pinched between the moveable die 1 and the stationary die 2, as shown in the figures. Additionally, the groove 7*e* formed in the external circumferential surface of the dummy cylinder liner 7 near the other end 7*b* enables the mounting direction of the dummy cylinder liner 7 to be readily ascertained when the dummy cylinder liner 7 is mounted to the liner support 4.

Figure 13:
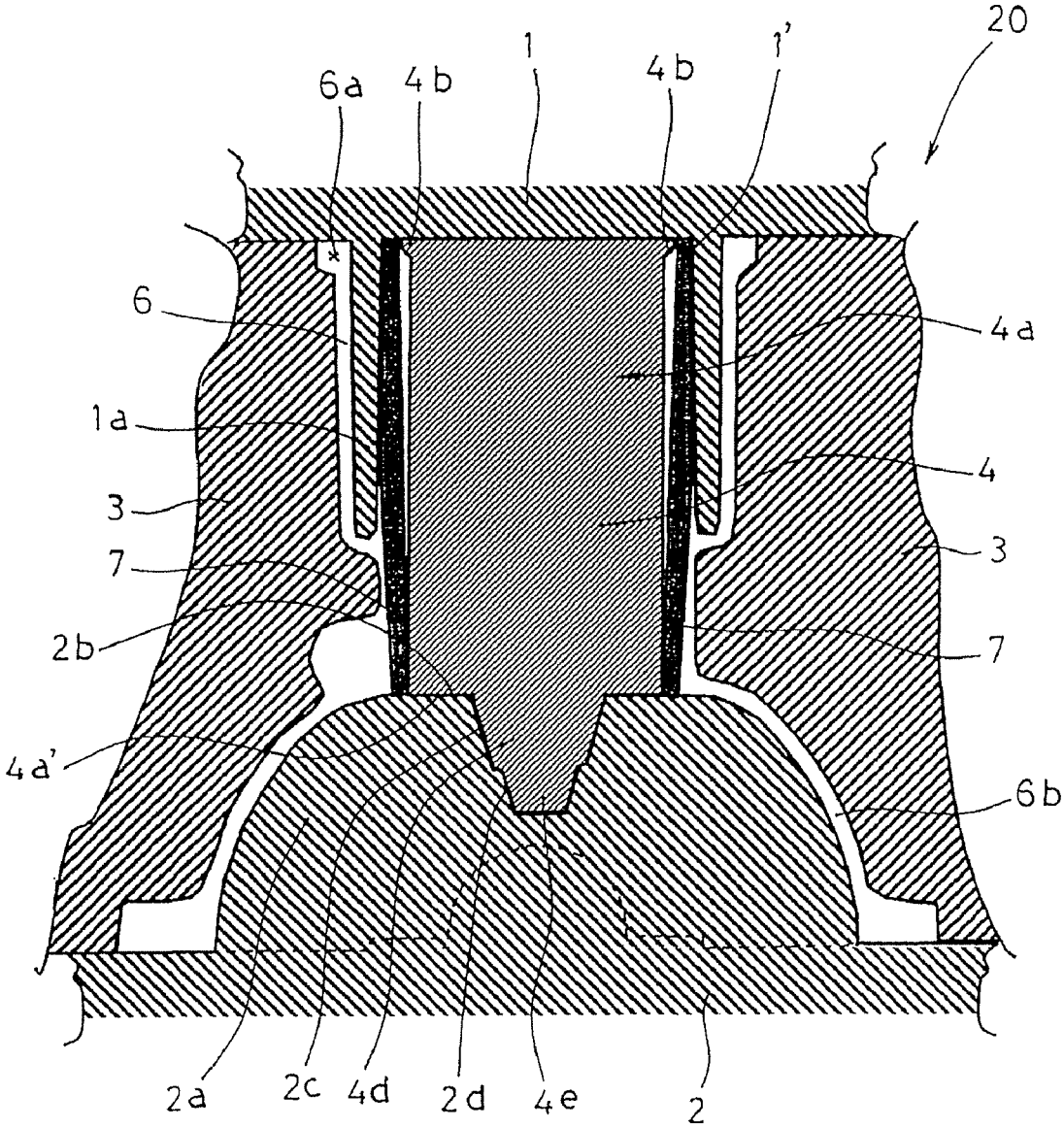
FIG. 13 illustrates a dummy cylinder liner 7 installed on a liner support 4 and pinched between a moveable die 1 and a stationary die 2 in a clamped state.
Figure 14:
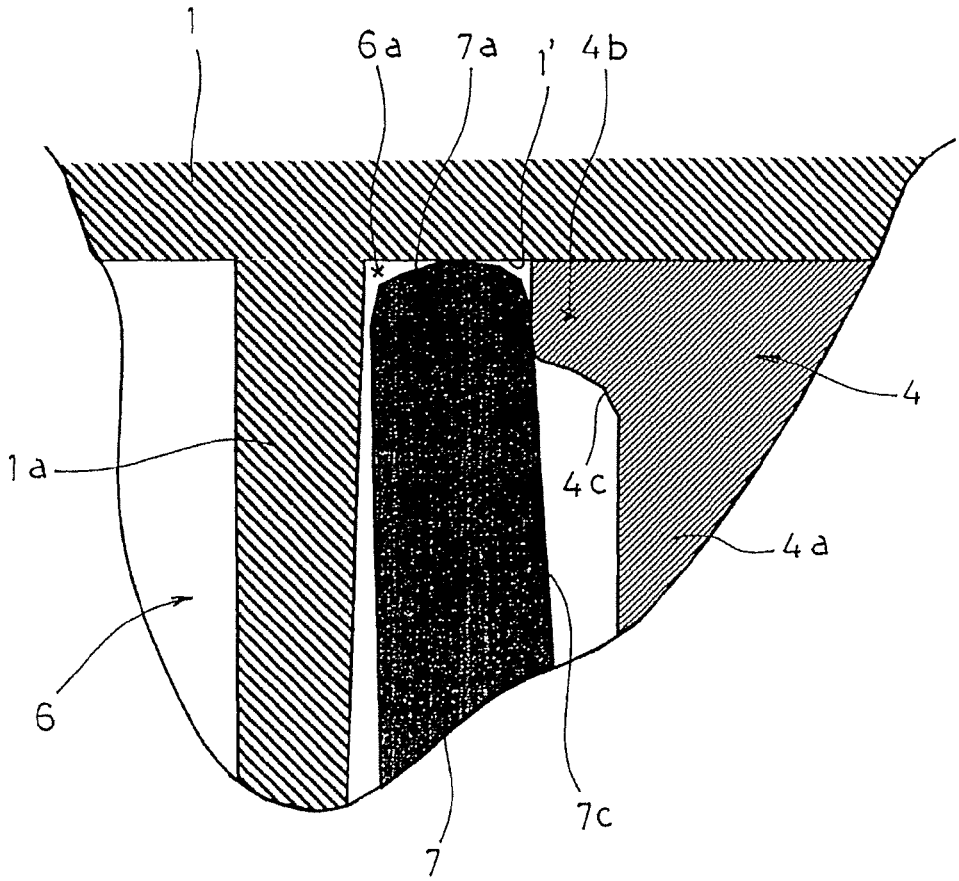
FIG. 14 is an enlarged view showing a vicinity of one end 7*a* of a dummy cylinder liner 7 pinched between a moveable die 1 and a stationary die 2.
Figure 15:
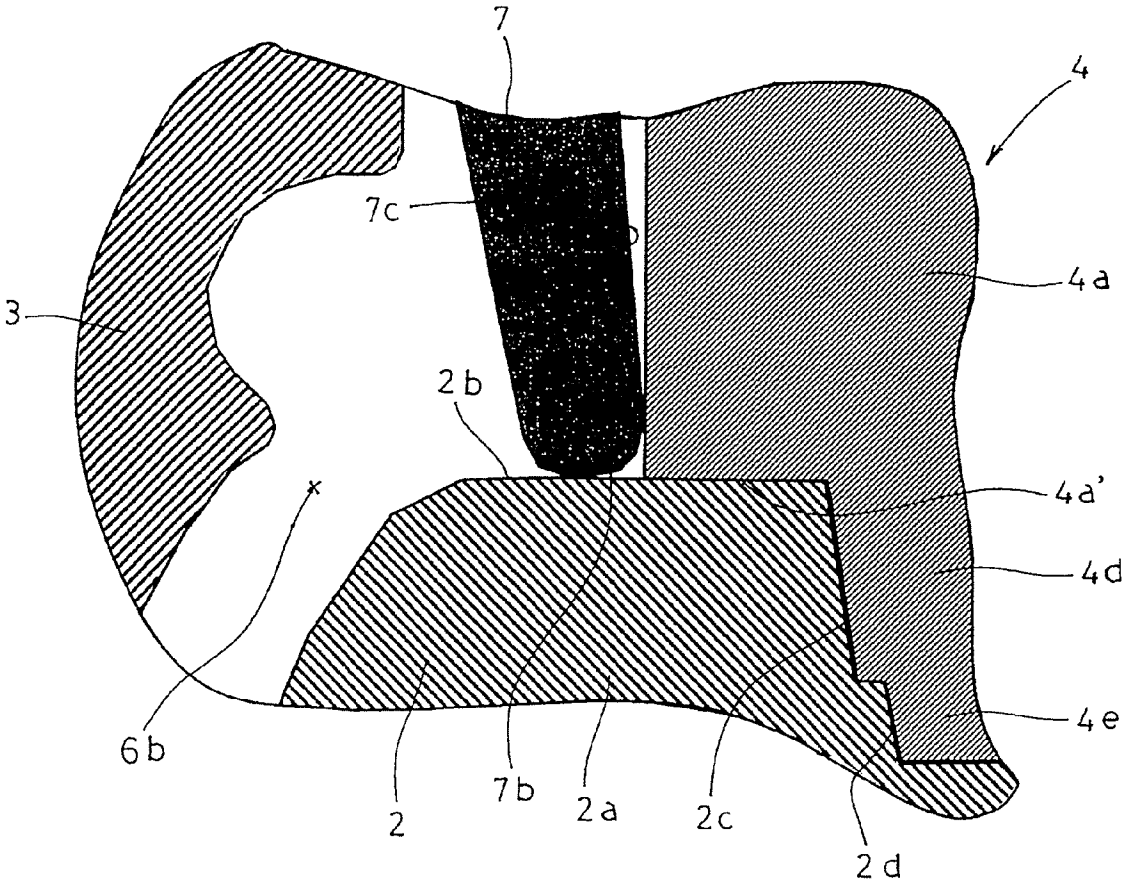
FIG. 15 is an enlarged view showing a vicinity of another end 7*b* of a dummy cylinder liner 7 pinched between a moveable die 1 and a stationary die 2.

FIG. 13 illustrates a dummy cylinder liner 7 installed on a liner support 4 and pinched between a moveable die 1 and a stationary die 2 in a clamped state, FIG. 14 is an enlarged view showing a vicinity of one end 7*a* of a dummy cylinder liner 7 pinched between a moveable die 1 and a stationary die 2, and FIG. 15 is an enlarged view showing a vicinity of another end 7*b* of a dummy cylinder liner 7 pinched between a moveable die 1 and a stationary die 2.

As shown in FIGS. 13, 14, and 15, the dummy cylinder liner 7 is arranged such that one end 7*a* touches against the mounting surface 1' of the moveable die 1 (on which the liner support 4 is attached) and the other end 7*b* touches against the flat surface 2*b* of the bulged section 2*a* of the stationary die 2. Since the internal diameter d2 of the dummy cylinder liner 7 at the one end 7*a* is the same as the external diameter of the pressing section 4*b* of the liner support 4 and the internal diameter d1 at the other end 7*b* is the same as the shaft section 4*a* of the liner support 4, the internal circumferential surface 7*c* at the one end 7*a* touches against an external circumferential surface of the pressing section 4*b* and the internal circumferential surface 7*c* at the other end 7*b* touches against an external circumferential surface of the shaft section 4*a*. When the dies and the dummy cylinder liner 7 are arranged as described above and the dies are clamped shut, a cylinder block molding cavity 6 comprising a deck surface molding cavity 6*a* and a crank chamber molding cavity 6*b* is formed inside the dies.

Next, a molten aluminum alloy is injected into the cylinder block molding cavity 6 (step S24). The molten aluminum alloy does not flow in-between the dummy cylinder liner 7 and the liner support 4 because of the good sealing achieved by the contact between the one end 7*a* of the dummy cylinder liner 7 and the mounting surface 1', the contact between the other end 7*b* of the dummy cylinder liner 7 and the flat surface 2*b* of the bulged section 2*a*, the contact between the internal circumferential surface 7*c* of the dummy cylinder liner 7 at the one end 7*a* and the pressing section 4*b*, and the contact between the circumferential surface 7*c* of the dummy cylinder liner 7 at the other end 7*b* and the shaft section 4*a*.

Finally, the molten aluminum alloy injected into mold is allowed to cool to complete the casting of a cylinder block having a cast-in dummy cylinder liner 7 (step S26). After the molten metal has cooled, the moveable die 1, the stationary die 2, and the moveable core 3 are separated and the dummy cylinder block is removed. A temperature of the dies is then detected to determine if it is higher than a prescribed temperature T* (step S28). If the die temperature is higher than the prescribed temperature, then the mold heating process is ended. If the die temperature is not higher than the prescribed temperature T*, then the die heating process, i.e., steps 20 to 28, are repeated until the die temperature exceeds the prescribed temperature T*.

In this embodiment, since the prescribed temperature T* is set to a temperature at which the molten metal can circulate readily throughout the mold (good fluidity), the die temperature is sufficiently high for a cylinder block having a cast-in iron-based cylinder liner 5 to be manufactured. As a result, the occurrence of such defects as internal cavities and misruns can be suppressed. Additionally, since the dummy cylinder liner 7 is made using the same aluminum alloy as is used to make the cylinder block, the dummy cylinder block(s) made during the die preheating step can be recycled more efficiently. More specifically, the dummy cylinder block and dummy cylinder liner can be recycled more easily because it is not necessary to separate the cylinder liner from the cylinder block before recycling (re-melting).

In a cylinder block manufacturing method according to the embodiment described above, a dummy cylinder liner 7 that is made of an aluminum alloy and longer in an axial direction than a iron-based cylinder liner 5 is used during a die preheating step instead of the iron-based cylinder liner 5. The dummy cylinder liner 7 is configured to be pinched between the moveable die 1 and the stationary die 2 when the dies are clamped together. As a result, molten metal is prevented from flowing in-between the liner support 4 and the dummy cylinder liner 7 and it is not necessary to machine an internal circumferential surface of the dummy cylinder liner 7. As a result, the cost of manufacturing a cylinder block can be reduced. Also, the dummy cylinder liner 7 has a simple structure because it is merely a generally cylindrical member that is longer in an axial direction than the iron-based cylinder liner 5. Since the dummy cylinder liner 7 is made of the same aluminum alloy as the molten metal used to make the cylinder block, dummy cylinder blocks cast during the die preheating step can be recycled in a more efficient manner.

Additionally, in a cylinder block manufacturing method according to the embodiment described above, since the internal diameter d2 of the dummy cylinder liner 7 at the one end 7*a* is the same as the external diameter of the pressing section 4*b* of the liner support 4 and the internal diameter d1 at the other end 7*b* is the same as an external diameter of the shaft section 4*a* of the liner support 4, seal are formed between the dummy cylinder liner 7 and an internal circumferential surface of the liner support 4 in addition to the seals formed at the axially facing end faces of the dummy cylinder liner 7. As a result, molten metal can be prevented from flowing in-between the liner support 4 and the dummy cylinder liner 7. Also, since a groove 7*e* serving as a mark is formed in an external circumferential surface of the dummy cylinder liner 7 near the other end 7*b*, the mounting direction of the dummy cylinder liner 7 can be easily confirmed when the dummy cylinder liner 7 is mounted to the liner support 4.

With a cylinder block manufacturing method according to the embodiment described above, the cost of manufacturing a cylinder block can be reduced because the dummy cylinder liner 7 is used in the form of an unfinished raw casting.

Although in a cylinder block manufacturing method according to the embodiment described above the taper of the internal circumferential surface 7*c* is sufficient to form a draft angle, it is acceptable for the taper of the internal circumferential surface 7*c* to be larger than a draft angle in accordance with the relative sizes of the external diameter of the pressing section 4*b* of the liner support 4 and the external diameter of the shaft section 4*a* of the liner support 4.

In a cylinder block manufacturing method according to the embodiment described above, the dummy cylinder liner 7 is configured such that the internal diameter d2 at the one end 7*a* is the same as an external diameter of the pressing section 4*b* of the liner support 4 and the internal diameter d1 at the other end 7*b* is the same as an external diameter of the shaft section 4*a* of the liner support 4. However, so long as the dummy cylinder liner 7 can be pinched between the moveable die 1 and the stationary die 2 when the dies are clamped, it is also acceptable for the dummy cylinder liner 7 to be configured such that the internal diameter d2 is the larger than the external diameter of the pressing section 4*b* and the internal diameter d1 is larger than the external diameter of the shaft section 4*a*.

Although in a cylinder block manufacturing method according to the embodiment described above the groove 7*e* is formed in the external circumferential surface of the dummy cylinder liner 7 near the other end 7*b*, it is also acceptable for a groove to be formed in a portion of the external circumferential surface near the one end 7*a*.

Although in a cylinder block manufacturing method according to the embodiment described above the groove 7*e* is formed completely around an external circumference of the dummy cylinder liner 7 near the other end 7*b*, it is also acceptable for a groove 7*e* to be formed only partially around an external circumference near the other end 7*b* so long as the direction of the dummy cylinder liner 7 can be ascertained.

Although in a cylinder block manufacturing method according to the embodiment described above a groove 7*e* is formed in the external circumferential surface of the dummy cylinder liner 7 near the other end 7*b* as an indicating mark, it is also acceptable for a protrusion, a knurled pattern, or a painted mark to be formed instead so long as the direction of the dummy cylinder liner 7 can be ascertained.

Although the groove 7*e* is formed by die casting in a cylinder block manufacturing method according to the embodiment described above, it is also acceptable to form a groove using a machining method.

Although the dummy cylinder liner 7 is formed by casting in a cylinder block manufacturing method according to the embodiment described above, it is acceptable for the dummy cylinder liner to be formed by forging or by using pipe material.

Although the present invention is explained herein using an embodiment, the present invention is not limited to the embodiment and it should be clear to those skilled in the art that various other embodiments can be contrived without departing from the scope of the invention as stipulated in the claims.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion,"

"member" or "element" when used in the singular can have the dual meaning of a single part or a plurality of parts.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A cylinder block manufacturing method comprising:

providing a first die that forms a portion of a deck surface molding cavity of a cylinder block molding cavity;

providing a second die that forms a portion of a crank chamber molding cavity of the cylinder block molding cavity;

providing a liner support including a shaft section and a pressing section that protrudes from the shaft section in a step-like manner so as to have a larger diameter than the shaft section for forming a liner overcast configuration;

determining whether a temperature of the first and second dies is higher than a prescribed temperature;

preheating the first and second dies to the prescribed temperature, when it is determined that the temperature of the first and second dies is not higher than the prescribed temperature, by positioning a dummy cylinder liner that is made of an aluminum alloy on the liner support, positioning the first and second dies with respect to the liner support and the dummy cylinder liner such that the first die contacts the pressing section of a first axial end of the liner support and a first axially facing end of the dummy cylinder liner, and such that the second die contacts a second axial end of the liner support that is opposite to the first axial end of the liner support and a second axially facing end of the dummy cylinder liner that is opposite the first axially facing end of the dummy cylinder liner, injecting molten aluminum alloy into cylinder block molding cavities, which are formed with the first and second dies being closed, to form a dummy cylinder block with the dummy cylinder liner casted in the dummy cylinder block, and removing the dummy cylinder block with the dummy cylinder liner casted in the dummy cylinder block from the liner support and the first and second dies; and manufacturing the cylinder block, when it is determined that the temperature of the first and second dies is higher than the prescribed temperature, by positioning an iron-based cylinder liner on the liner support such that the shaft section of the liner support contacts an internal circumferential surface of the iron-based cylinder liner, positioning the first and second dies with respect to the liner support and the iron-based cylinder liner such that the first die contacts the pressing section of the liner support, such that the pressing section contacts against a portion of a first axially facing end of the iron-based cylinder liner with the deck surface cavity formed between the first die and a first axially facing end of the iron-based cylinder liner, such that the second die contacts the second axial end of the liner support, and such that a second axially facing end of the iron-based cylinder liner contacts the second die, and injecting a molten aluminum alloy into the cylinder block molding cavities, which are formed with the first and second dies being closed, to form a cylinder block with the iron-based cylinder liner casted in the cylinder block and such that the aluminum alloy overlies the first axially facing end of the iron-based cylinder liner to overcast the first axially facing end of the iron-based cylinder liner.

2. The cylinder block manufacturing method as recited in claim 1, wherein the positioning of the dummy cylinder liner on the liner support is performed with the dummy cylinder liner being an unfinished raw casting.

3. The cylinder block manufacturing method as recited in claim 2, wherein the dummy cylinder liner has an internal bore with a tapered shape such that a first internal diameter of the dummy cylinder liner at the first axially facing end is substantially equal to an external diameter of the pressing section of the liner support to circumferentially overlie the pressing section, and such that a second internal diameter of the dummy cylinder liner at the second axially facing end is substantially equal to an external diameter of the shaft section of the liner support to circumferentially overlie the shaft section.

4. The cylinder block manufacturing method as recited in claim 3, wherein the dummy cylinder liner includes a mark formed in a position closer to one of the first and second axially facing ends.

5. The cylinder block manufacturing method as recited in claim 4, wherein the mark formed on the dummy cylinder liner is a groove.

6. The cylinder block manufacturing method as recited in claim 4, wherein the mark is formed on the dummy cylinder liner by a die during casting of the dummy cylinder liner.

7. The cylinder block manufacturing method as recited in claim 1, wherein the preheating of the first and second dies including the positioning of the dummy cylinder liner on the liner support, the positioning the first and second dies with respect to the liner support and the dummy cylinder liner, the preheating of the first and second dies and the removing of the dummy cylinder block is performed a plurality of times until the first and second dies reach the prescribed temperature.

* * * * *